US006998022B2

(12) United States Patent
Hultcrantz

(10) Patent No.: US 6,998,022 B2
(45) Date of Patent: Feb. 14, 2006

(54) PAPER MACHINE AND PRESS SECTION THEREOF

(75) Inventor: Magnus Hultcrantz, Deje (SE)

(73) Assignee: Metso Paper Karlstad Aktiebolag, Karlstad (SE)

( * ) Notice: Subject to any disclaimer, the term of this patent is extended or adjusted under 35 U.S.C. 154(b) by 354 days.

(21) Appl. No.: 10/299,106

(22) Filed: Nov. 18, 2002

(65) Prior Publication Data

US 2003/0121626 A1 Jul. 3, 2003

Related U.S. Application Data

(63) Continuation of application No. PCT/SE01/01027, filed on May 11, 2001.

(60) Provisional application No. 60/212,119, filed on Jun. 16, 2000.

(51) Int. Cl.
*D21F 3/02* (2006.01)
*D21F 11/14* (2006.01)

(52) U.S. Cl. ..... 162/289; 162/358.1; 162/363; 162/361; 162/367; 162/373

(58) Field of Classification Search ..... 162/289, 162/358.1, 358.3, 361, 363, 367, 368–373, 162/359.1
See application file for complete search history.

(56) References Cited

U.S. PATENT DOCUMENTS 1,905,911 A * 4/1933 Kellett ..... 162/360.2
2,666,371 A * 1/1954 Beachler ..... 162/290
2,694,347 A * 11/1954 Hornbostel ..... 162/359.1
2,694,348 A * 11/1954 Beachler ..... 162/359.1
2,784,652 A * 3/1957 Hornbostel ..... 162/360.3
2,892,263 A * 6/1959 Hornbostel ..... 34/120
2,996,424 A * 8/1961 Voigtman et al. ..... 162/112
3,198,695 A * 8/1965 Justus ..... 162/359.1
3,560,333 A * 2/1971 Douglas et al. ..... 162/206
3,691,010 A 9/1972 Krake
3,981,084 A 9/1976 Sobota
4,055,461 A 10/1977 Turunen
4,911,791 A * 3/1990 Mokvist ..... 162/290
5,230,776 A 7/1993 Andersson et al.
5,306,395 A * 4/1994 Myren ..... 162/301
5,397,437 A * 3/1995 Myren ..... 162/203
6,004,429 A * 12/1999 Schiel ..... 162/111
6,083,349 A * 7/2000 Schiel ..... 162/206
6,235,160 B1 5/2001 Tietz et al.
6,488,816 B1 * 12/2002 Klerelid ..... 162/359.1

(Continued)

FOREIGN PATENT DOCUMENTS

EP 0 851 059 A1 7/1998

(Continued)

*Primary Examiner*—José A. Fortuna
*Assistant Examiner*—B Murphy
(74) *Attorney, Agent, or Firm*—Alston & Bird LLP

(57) ABSTRACT

A soft crepe paper machine comprises a wet section with a press section having a press defined by first and second press elements forming a press nip through which a press felt runs with a paper web. A suction roll is arranged in the loop of the press felt before the press nip at a distance from the second press element, and the felt with the web thereon runs around the suction roll with a large wrap angle. A drying cylinder forms the second press element. The first press element is either a solid press roll, a suction press roll, or a variable crown press roll.

39 Claims, 5 Drawing Sheets

U.S. PATENT DOCUMENTS

Figure 1:
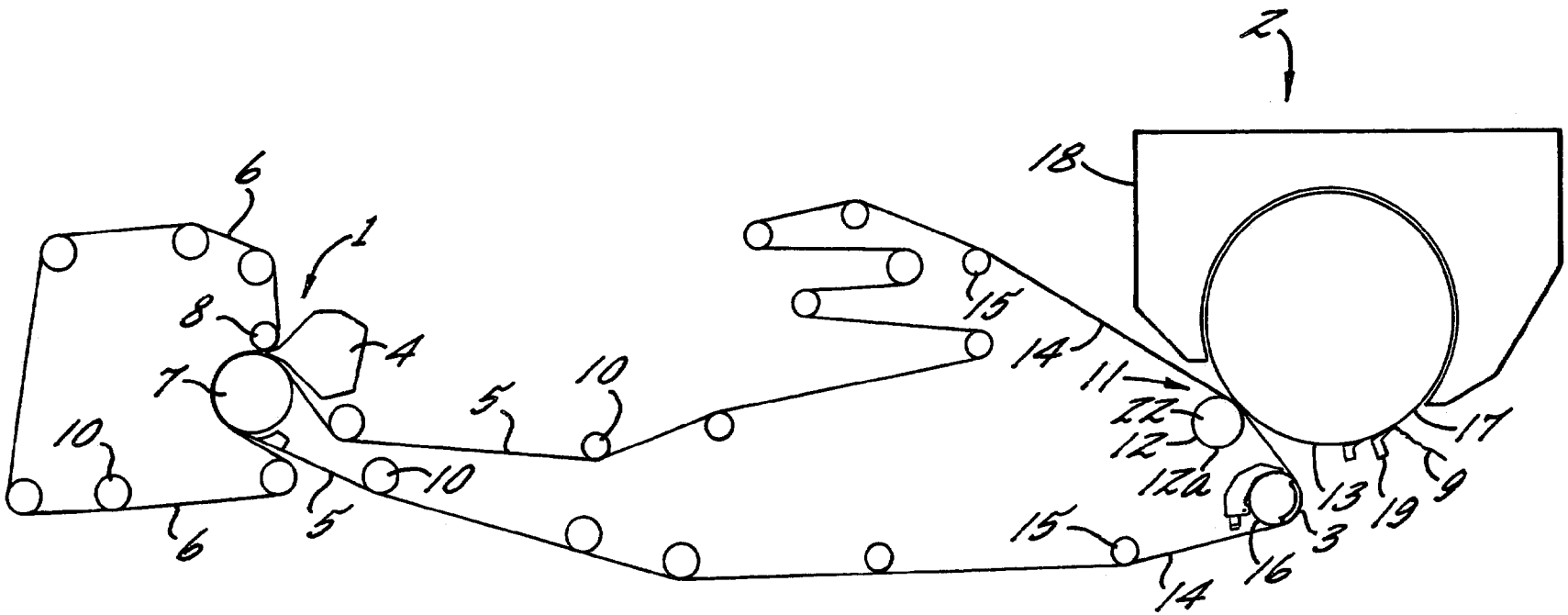

| | | | | |
|---|---|---|---|---|
| 6,780,282 | B1 * | 8/2004 | Scherb et al. | 162/111 |
| 2002/0060046 | A1 * | 5/2002 | Scherb et al. | 162/358.1 |
| 2003/0121626 | A1 * | 7/2003 | Hultzcrantz | 162/111 |
| 2003/0136018 | A1 * | 7/2003 | Herman et al. | 34/114 |
| 2004/0237210 | A1 * | 12/2004 | Thoroe-Scherb et al. | 8/115.51 |

FOREIGN PATENT DOCUMENTS

| | | | |
|---|---|---|---|
| EP | 0 854 229 | A2 | 7/1998 |
| EP | 0 928 843 | A2 | 7/1999 |
| GB | 2 074 624 | A | 11/1981 |

* cited by examiner

PAPER MACHINE AND PRESS SECTION THEREOF

CROSS-REFERENCE TO RELATED APPLICATION

This application is a continuation of International Patent Application PCT/SE01/01027 filed on May 11, 2001, which claims the benefit of 60/212,119, filed Jun. 16, 2000, which designated inter alia the United States and was published in English under PCT Article 21(2).

FIELD OF THE INVENTION

The present invention relates to a machine for manufacturing a web of soft crepe paper, comprising a wet section, having a former and a press section, which press section comprises a press including a first press element and a second press element, which press elements define a press nip between them, a press felt carrying the web and running through the press nip, and a suction device arranged in the loop of the press felt before the press nip and at a distance from the second press element and having a curved suction zone, the press felt running over the suction zone and the suction device and the press felt being arranged so that the press felt has a large wrap angle around the suction device, and a drying section including a drying cylinder, which forms the second press element.

The invention also relates to a press section in a machine for manufacturing a web of soft crepe paper, comprising a press including a first press element and a second press element, which press elements define a press nip between them, the second press element being formed by a drying cylinder in the drying section of the machine, a press felt carrying the web and running through the press nip, and a suction device arranged in the loop of-the press felt before the press nip and at a distance from the second press element and having a curved suction zone, the press felt running over the suction zone and the suction device and the press felt being arranged so that the press felt has a large wrap angle around the suction device.

BACKGROUND OF THE INVENTION

U.S. Pat. No. 5,230,776 and U.S. Pat. No. 3,691,010 describe conventional machines with two presses, in both of which the drying cylinder acts as a counter roll and the first press has a suction press roll that can be crowned. To avoid running problems, the press felt must be conveyed out in a side loop between the two press nips. The web reaches the first press nip with a dry-solids content of about 10–15 percent. In a modified second embodiment of the machine in accordance with U.S. Pat. No. 5,230,776, the second press roll is disconnected and the web-carrying forming wire is extended to the first suction press roll while an open belt of wire type is substituted for the press felt to enclose the web between it and the forming wire, creating a sandwich construction that can be provided with airflow-generating means. Suction boxes can be arranged upstream of the sandwich construction in the loop of the forming wire. The known machine can thereby be modified from one operational embodiment to another that provides a higher dry-solids content, and thereby be adapted to different market needs. Thus, in the second embodiment, which is of a relatively complicated construction, the suction press roll is used in combination with an open belt and not solely with a press felt, and the suction means, located upstream of the suction press roll, are not arranged in a press-felt loop running through the press nip.

U.S. Pat. No. 4,055,461 describes a soft crepe paper machine having a pick-up suction roll and a press section with double press nips against a suction press roll, where the web is compressed in the first press nip before reaching the second press nip against the drying cylinder. Pressing the web in two press nips detrimentally affects the bulk of the paper.

So-called through-air drying can be used to increase the dry-solids content of the web before the drying cylinder. The increased dry-solids content allows the nip pressure to be reduced substantially in the subsequent press nip, in comparison with a conventional soft crepe paper machine, so that a desired high bulk is obtained. However, a through-air dryer represents high capital expenditure and requires additional space in the machine line. Furthermore, it has high running costs, as hot air is utilized.

In accordance with another technique for obtaining an increased dry-solids content before the press nip, a suction device is utilized and the pressing then takes place in an extended shoe press nip. A machine constructed in accordance with this technique is described in EP 0 926 296, which corresponds to U.S. Pat. No. 6,235,160. The press is a shoe press formed by a shoe press roll and a drying cylinder as the counter roll. The suction device is shown in the patent specification as a suction roll arranged before the extended shoe press nip at a distance from the drying cylinder. The suction roll enables the dry-solids content of the web to be increased to a high level before the press nip. Such an increased dry-solids content before the press nip is thus advantageous, as it becomes possible thereby to reduce the compression pressure in the press nip so that a substantially increased bulk can be obtained since the web is compressed to a lesser extent. However, a shoe press roll is a relatively complicated construction, entailing high capital expenditure and requiring special operational control.

Machines with similar shoe presses are described in EP 0 851 059 and EP 0 854 229, although, in both cases, a suction roll in the specified position before the shoe press nip is lacking.

SUMMARY OF THE INVENTION

It is therefore an object of the present invention to provide a soft crepe paper machine having a simpler press section, which results in reduced capital expenditure and enables a paper web with high bulk to be manufactured in a simpler and more cost effective way than has heretofore been possible, as well as enabling the user of the soft crepe paper machine to choose press elements in accordance with his specific needs.

The machine and press section in accordance with the invention are characterized in that the first press element that forms the press nip with the drying cylinder is selected from the group consisting of a solid press roll, a suction press roll, and a variable crown press roll. Advantageously, the machine and press section have only one press nip so that the bulk of the paper is not detrimentally affected.

In one embodiment, the first press element comprises a variable crown press roll operable to control a crown curve of a shell of the press roll independently in at least two zones of the press roll. For instance, the variable crown press roll can include a plurality of press members distributed within the shell along a length thereof for exerting radially outward forces on the shell, the press members being arranged in two outer groups and at least one inner group between the two outer groups, each group of press members being controlled independently of the other groups so as to form a plurality of zones of the shell in each of which the crown curve of the shell is independently adjustable, whereby a compression pressure profile imparted to the web in the press nip is controlled by the variable crown press roll.

Advantageously, the press felt passes around the suction device with a wrap angle thereabout of at least about 100°, and more preferably at least about 110°. This increases the residence time of the web in the suction zone and thereby leads to increased dry solids content of the web before reaching the drying cylinder.

The former in one embodiment forms the web on the felt. In an alternative embodiment, the former includes an inner web-carrying clothing on which the web is formed, the clothing carrying the web to a transfer point at which the web is transferred from the clothing onto the felt.

BRIEF DESCRIPTION OF THE SEVERAL VIEWS OF THE DRAWING(S)

Having thus described the invention in general terms, reference will now be made to the accompanying drawings, which are not necessarily drawn to scale, and wherein:

FIG. 1 schematically shows a soft crepe paper machine with a press section in accordance with a first embodiment of the invention.

Figure 2:
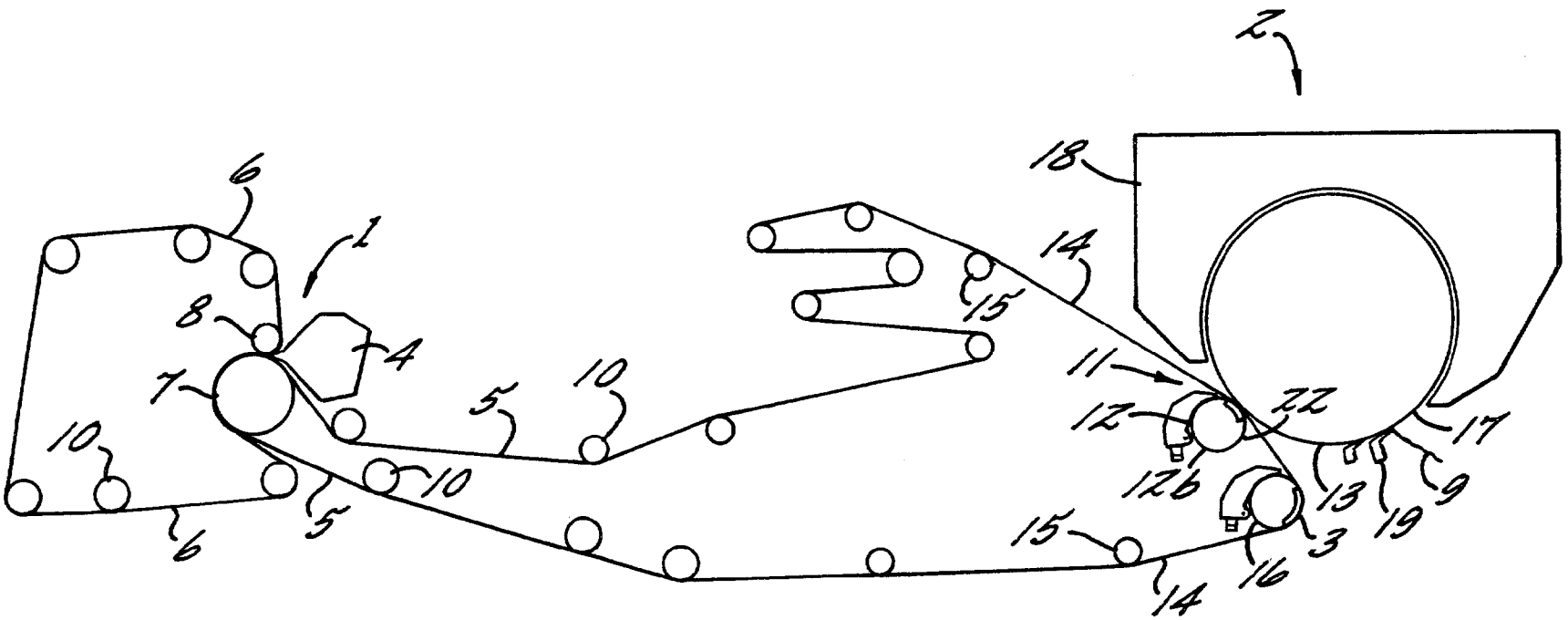

FIG. 2 schematically shows a soft crepe paper machine with a press section in accordance with a second embodiment of the invention.

Figures 3, 3A:
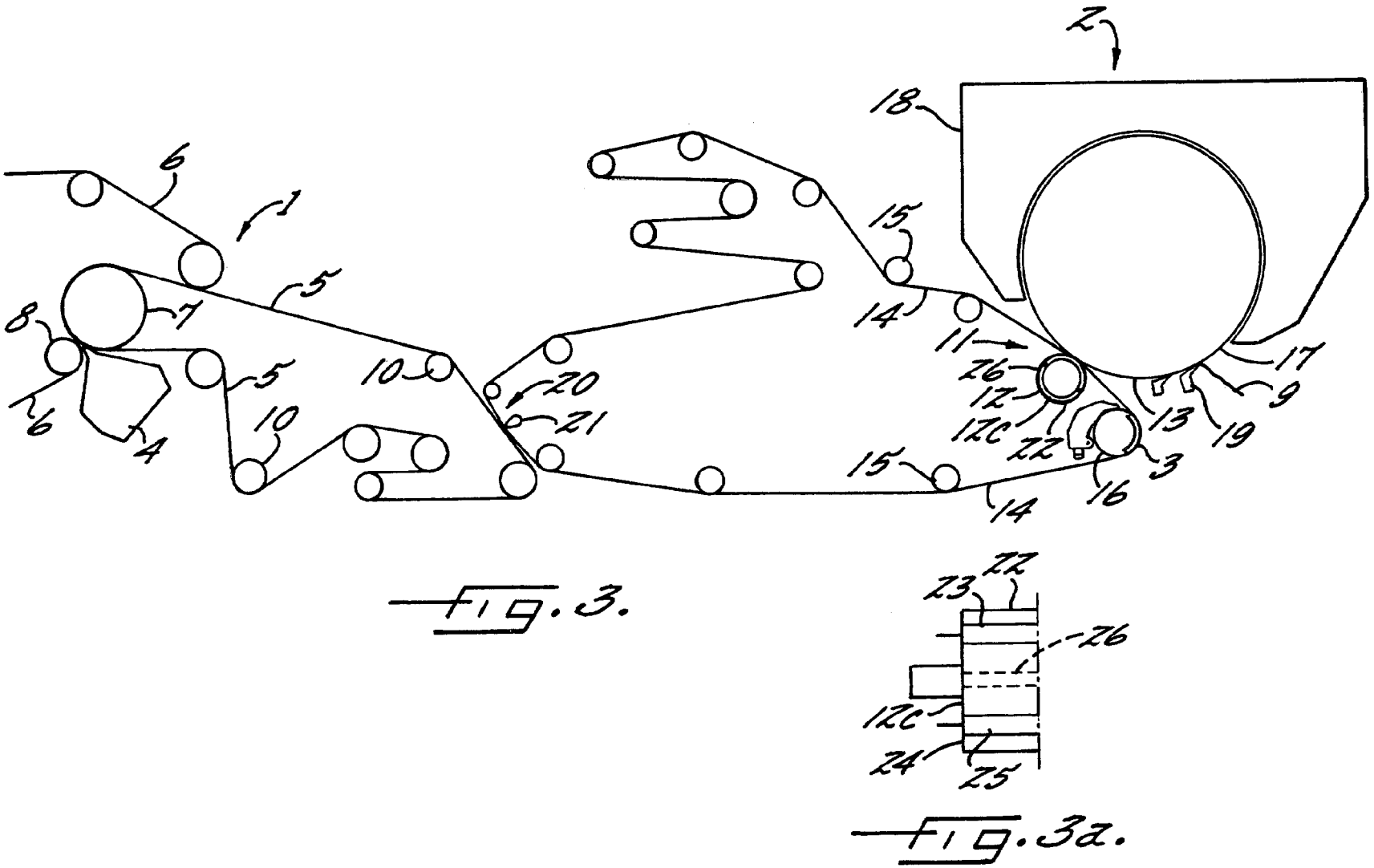

FIG. 3 schematically shows a soft crepe paper machine with a press section in accordance with a third embodiment of the invention.

FIG. 3*a* is a longitudinal sectional view of one of the end portions of a variable crown press roll in the press section in accordance with FIG. 3.

Figure 4:
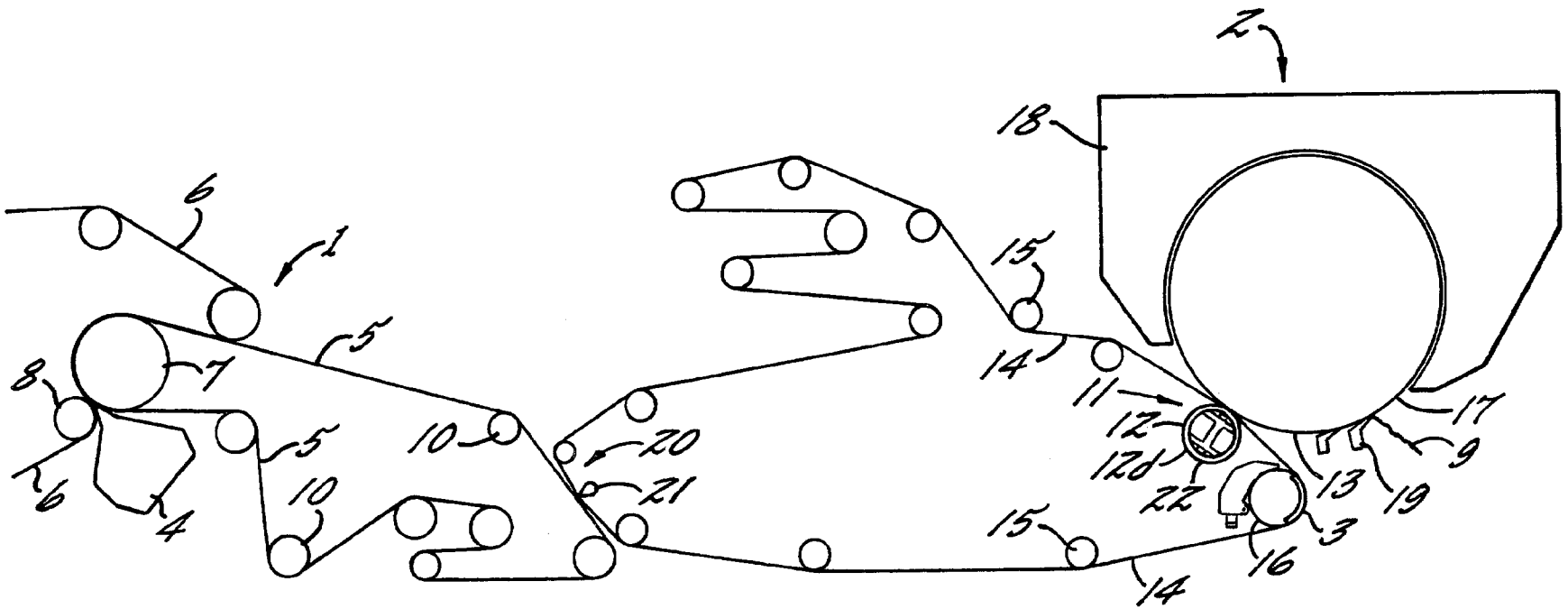

FIG. 4 schematically shows a soft crepe paper machine with a press section in accordance with a fourth embodiment of the invention.

Figure 4A:
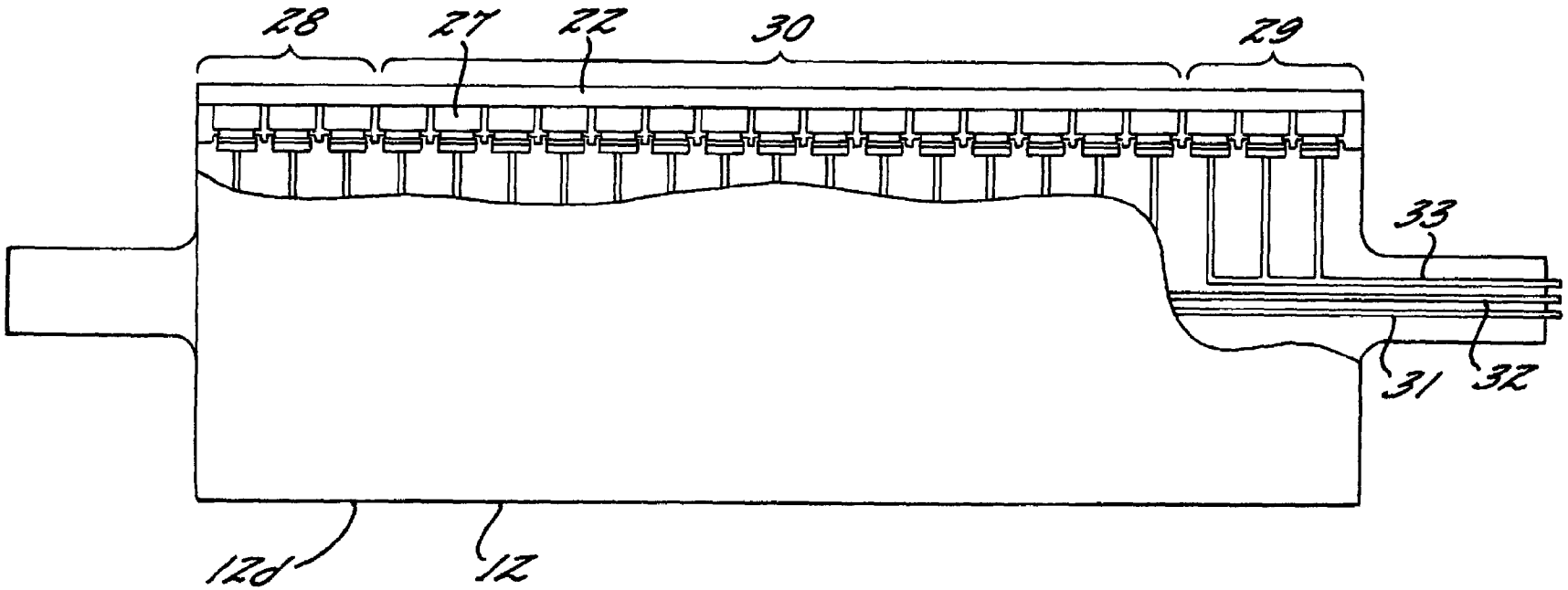

FIG. 4*a* is a longitudinal sectional view of a zone-controllable, variable crown press roll in the press section in accordance with FIG. 4.

DETAILED DESCRIPTION OF THE INVENTION

The present inventions now will be described more fully hereinafter with reference to the accompanying drawings, in which some, but not all embodiments of the invention are shown. Indeed, these inventions may be embodied in many different forms and should not be construed as limited to the embodiments set forth herein; rather, these embodiments are provided so that this disclosure will satisfy applicable legal requirements. Like numbers refer to like elements throughout.

FIGS. 1–4 schematically show parts of paper machines for manufacturing soft crepe paper such as tissue and other creped hygiene paper products. Each paper machine comprises a wet section 1 and a drying section 2. The wet section 1 comprises a former and a press section. The former has a headbox 4, an inner, carrying forming clothing 5, an outer, covering forming clothing 6, a forming roll 7 and a breast roll 8. The forming roll 7 and the breast roll 8 are arranged in proximity to each other so that the two forming clothings 5, 6 run together on the forming roll 7 whilst defining a wedge-shaped gap between them before they run together, the headbox 4 delivering a single- or multi-layer jet of stock into said gap to form a paper web 9 by way of the stock being dewatered. The two forming clothings 5, 6 run together over the forming roll 7 and then in individual loops over a plurality of rolls 10 arranged to move, guide, align and stretch the forming clothings 5, 6.

The press section comprises a roll press 11, consisting of a first press roll 12 and a second press roll 13, which press rolls 12, 13 define a press nip between them. It is preferable for the press section to have only one press, i.e. roll press, as shown in the drawings, so that no additional press nip is formed against the second press roll 13 or against the first press roll 12 or defined by any two other press elements. Further, the press section has a press felt 14, running through the press nip and in a loop around a plurality of rolls 15, arranged to move, guide, align and stretch the press felt 14. Devices (not shown) for cleaning the press felt 14 are located after the press nip. In the loop of the press felt 14, there is a suction device 16, which, in the embodiment shown, consists of a suction roll that is arranged just before the press nip and from which the press felt 14 carries the web 9 so that the side of the web 9 facing away from the felt is free from contact with any structural element before the press nip. The suction device 16, which has a curved suction zone 3, is so arranged in relation to the nearest upstream guide roll 15 and the downstream press roll 12 that the press felt 14 has a high wrap around the suction device 16, i.e. the press felt 14 and the paper web 9 carried by the same change direction at a large angle over the suction zone 3. The wrap angle should be at least 100°, preferably at least 110°. In experiments performed with a suction roll, the wrap angle has been about 140°. The suction zone 3 encloses a sector angle corresponding to said wrap angle and extends within the same. The large wrap angle contributes to increased dewatering. The suction device 16 is arranged to provide the paper web 9 with a dry-solids content of at least 15 percent, preferably at least 20 percent and most preferably at least 25 percent.

The drying section 2 comprises a crowned drying cylinder 17 having a relatively large diameter and a polished envelope surface. The drying cylinder 17, which preferably consists of a Yankee cylinder, is covered by a hood 18, in which hot air is blown at high speed against the paper web 9. The paper web is creped away from the drying cylinder 17 with the aid of a crepe doctor 19 to obtain desired creping, whereupon the finished creped paper web 9 is reeled onto a reel (not shown). The drying cylinder 17 also forms said second press roll 13 in the roll press 11 of the drying section 2. Said suction roll 16 is arranged at a distance from the drying cylinder 17 so that no press nip is formed between them and so that the web 9 does not come into contact with the envelope surface of the drying cylinder 17 until it reaches the press nip or immediately before.

In the paper machines in accordance with FIGS. 1 and 2, the inner carrying forming clothing 5 consists of a forming felt, the loop of which is extended to the press section 2 so that it also acts as said press felt 14.

In the paper machines in accordance with FIGS. 3 and 4, the inner carrying forming clothing 5 consists of a forming wire, the loop of which encounters the loop of the press felt 14 in a transfer zone 20 for transferring the web 9 to the press felt 14, a suction shoe 21 being arranged within said transfer zone 20 in the loop of the press felt 14.

In the paper machine in accordance with FIG. 1, the first press roll 12 of the roll press 11 consists of a press roll 12*a* with a solid shell 22 that can be smooth, grooved or blind-drilled. The press roll 12*a* can be straight depending on the crown of the drying cylinder 13, amongst other things, but is preferably crowned so that it has a crown curve corresponding to a certain compression pressure to obtain profiles for compression pressure and dry-solids content that are as uniform as possible after pressing without zones with higher moisture occurring in the web after the press nip.

In the paper machine in accordance with FIG. 2, the first press roll 12 of the roll press 11 consists of a suction press roll 12*b* that can be straight depending on the crown of the drying cylinder, amongst other things, but which is preferably crowned so that it has a crown curve corresponding to a certain compression pressure to obtain profiles for compression pressure and dry-solids content that are as uniform as possible without zones with higher moisture occurring in the web after the press nip. A special advantage of the suction press roll 12*b* is that it also has a cleaning effect on the press felt 14 so that special cleaning means arranged after the press nip can be completely or partly reduced and the frequency of felt replacements can be diminished.

In the paper machine in accordance with FIG. 3, the first press roll 12 of the roll press 11 consists of a variable crown press roll 12*c*, the shell of which can be smooth, grooved or blind-drilled. The crown curve of the press roll 12*c* can be changed during operation to be adapted to a predetermined compression pressure so that as uniform as possible profiles for compression pressure and dry-solids content are obtained without zones with higher moisture occurring in the web after the press nip. If the machine is to manufacture a soft crepe paper of a different desired grade with respect to bulk and strength, the crown curve is changed to correspond to a new compression pressure so that as uniform as possible profiles for compression pressure and dry-solids content for the new setting are obtained without zones with higher moisture occurring in the web after the press nip. FIG. 3*a* schematically shows a longitudinal section of one of the end portions of the variable crown press roll 12*c*, the shell 22 of which surrounds an upper pressure chamber 23, connected to a pressure source (not shown). The pressure chamber 23 extends between the end walls 24 of the press roll, the ends of the shell 22 being rigidly attached to said end walls. Changing the pressure in the pressure chamber 23 produces a corresponding change of the crown curve within the press nip. The shell 22 also surrounds a lower pressure chamber 25 having a predetermined lower pressure than the upper pressure chamber 23. The pressure chambers are separated by opposite, axial sliding sealings 26.

In the paper machine in accordance with FIG. 4, the first press roll 12 of the roll press 11 consists of a zone-controllable, variable crown press roll 12*d*, the shell 22 of which can be smooth, grooved or blind-drilled. The crown curve of the press roll 12*d* can be changed during operation to be adapted to a predetermined compression pressure so that as uniform as possible profiles for compression pressure and dry-solids content are obtained without zones with higher moisture occurring in the web after the press nip. If the machine is to manufacture a soft crepe paper of a different desired grade with respect to bulk and strength, the crown curve is changed to correspond to a new compression pressure so that as uniform as possible profiles for compression pressure and dry-solids content for the new setting are obtained without zones with higher moisture occurring in the web after the press nip. In this embodiment, the crown curve can additionally be influenced zone by zone so as to adjust the compression pressure profile within the corresponding parts so that the profile becomes even more uniform and straighter than is possible with a variable crown press roll that is not zone-controllable to obtain a dry-solids content profile after the press nip that is correspondingly more uniform and straighter. FIG. 4*a* shows schematically a longitudinal section of the zone-controllable, variable crown press roll 12*d*, which has an axial row of pressing members 27 equidistantly arranged inside the shell 22 and opposite to the press nip. With respect to their pressing influence on the shell 22, the pressing members 27 are divided into two outer groups 28, 29 and an inner or intermediate group 30 between them, the groups 28, 29, 30 of pressing members 27 being actuated independently of each other via separate ducts 31, 32 and 33, respectively, provided with valves. Each group of pressing members 27 actuates its corresponding axial zone of the shell and, consequently, the crown curve.

The drying cylinder 13 is crowned in at least the embodiments in accordance with FIGS. 1–3. A special advantage of the embodiment in accordance with FIG. 4 is that the drying cylinder 13 does not need to be crowned.

In all cases, the press roll 12 is driven and its shell 22 comprises an outer layer of a rubber material or a rubber-like material. Alternatively, other materials could be used for this outer layer, as long as such materials do not cause damage to the surface of the drying cylinder in case of direct contact with the surface. The thickness and softness of the rubber layer is chosen as needed. A certain compression of the rubber layer occurs in the press nip so that it is extended somewhat in the direction of movement of the web. It should thus be understood that the thickness and softness of the outer layer determine the length of the extended press nip at a given compression pressure. The linear load, which corresponds to the impulse of pressure, is a function of compression pressure, pressing time and machine speed. If the compression pressure is increased, the pressing time will increase as well, since the rubber layer of the shell is compressed further so that the press nip becomes longer.

Each one of the described roll presses is of a substantially simpler construction than the known shoe press in accordance with EP 0 926 296, which results in reduced capital expenditure and enables the manufacture of a soft crepe paper with a bulk substantially as high as with the said known shoe press, but in a simpler and more cost effective way. Furthermore, the user has the advantageous opportunity of choosing, out of the alternatives, the press roll that is most suited to the specific needs of the user as regards whether the same grade is to be produced for a longer period of time (suitably press roll 12*a* or 12*b*) or different grades are to be produced alternatingly in smaller series (suitably press roll 12*c* or 12*d*).

In a further embodiment (not shown) the first press element is a press roll having at least two of the properties of the four press rolls 12*a* to 12*d* described above, such as, for instance, a variable crown suction press roll.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

What is claimed is:

1. A machine for manufacturing a web of paper, comprising:

a former for forming a wet web;

a press section for pressing the wet web; and a drying section having a drying cylinder;

wherein the press section comprises:

a first press element comprising a press roll and forming a press nip with the drying cylinder;

a press felt forming an endless loop, the press felt carrying the web through the press nip; and a suction device arranged in the loop of the press felt and located upstream of the press nip, the suction device having a curved suction zone and the press felt with the web thereon running over the suction zone such that the dry solids content of the web is increased by the suction device prior to the web passing through the press nip, and the suction device being spaced at a distance from the drying cylinder, wherein the press section is structured and arranged such that from the suction device to the press nip, a side of the web facing away from the felt is free from contact with any structural element until said side of the web contacts the drying cylinder in the press nip;

wherein the first press element comprises a roll selected from the group consisting of a solid press roll, a suction press roll, and a variable crown press roll, said roll being driven.

2. The machine of claim 1, wherein the first press element comprises a variable crown press roll operable to control a crown curve of a shell of the press roll independently in at least two zones of the press roll.

3. The machine of claim 2, wherein the variable crown press roll includes a plurality of press members distributed within the shell along a length thereof for exerting radially outward forces on the shell, the press members being arranged in two outer groups and at least one inner group between the two outer groups, each group of press members being controlled independently of the other groups so as to form a plurality of zones of the shell in each of which the crown curve of the shell is independently adjustable, whereby a compression pressure profile imparted to the web in the press nip is controlled by the variable crown press roll.

4. The machine of claim 1, wherein the press felt passes around the suction device with a wrap angle thereabout of at least about 100°.

5. The machine of claim 1, wherein the press felt passes around the suction device with a wrap angle thereabout of at least about 110°.

6. The machine of claim 1, wherein the suction device is operable to increase the dry solids content of the web to at least 15 percent.

7. The machine of claim 1, wherein the suction device is operable to increase the dry solids content of the web to at least 20 percent.

8. The machine of claim 1, wherein the suction device is operable to increase the dry solids content of the web to at least 25 percent.

9. The machine of claim 1, wherein the first press element comprises a press roll having a grooved or blind-drilled shell.

10. The machine of claim 1, wherein the suction device comprises a suction roll.

11. The machine of claim 1, wherein the former forms the web on the press felt.

12. The machine of claim 1, wherein the former includes an inner web-carrying clothing on which the web is formed, the clothing carrying the web to a transfer point at which the web is transferred from the clothing onto the press felt.

13. A press section for a machine manufacturing a web of paper, comprising:

a press including a first press element comprising a press roll and a second press element forming a press nip with the first press element, the second press element comprising a drying cylinder of a drying section of the machine;

a press felt forming an endless loop, the press felt carrying the web through the press nip; and a suction device arranged in the loop of the press felt and located upstream of the press nip, the suction device having a curved suction zone and the press felt with the web thereon running over the suction zone such that the dry solids content of the web is increased by the suction device prior to the web passing through the press nip, and the suction device being spaced at a distance from the drying cylinder and first press element, wherein the press section is structured and arranged such that from the suction device to the press nip, a side of the web facing away from the felt is free from contact with any structural element until said side of the web contacts the drying cylinder in the press nip;

wherein the first press element comprises a roll selected from the group consisting of a solid press roll, a suction press roll, and a variable crown press roll, said roll being driven.

14. The press section of claim 13, the wherein the first press element comprises a variable crown press roll operable to control a crown curve of a shell of the press roll independently in at least two zones of the press roll.

15. The press section of claim 14, wherein the variable crown press roll includes a plurality of press members distributed within the shell along a length thereof for exerting radially outward forces on the shell, the press members being arranged in two outer groups and at least one inner group between the two outer groups, each group of press members being controlled independently of the other groups so as to form a plurality of zones of the shell in each of which the crown curve of the shell is independently adjustable, whereby a compression pressure profile imparted to the web in the press nip is controlled by the variable crown press roll.

16. The press section of claim 13, wherein the press felt passes around the suction device with a wrap angle thereabout of at least about 100°.

17. The press section of claim 13, wherein the press felt passes around the suction device with a wrap angle thereabout of at least about 110°.

18. The press section of claim 13, wherein the suction device is operable to increase the dry solids content of the web to at least 15–25 percent.

19. The press section of claim 13, wherein the first press element comprises a press roll having a grooved or blind-drilled shell.

20. The press section of claim 13, wherein the suction device comprises a suction roll.

21. A machine for manufacturing a web of paper, comprising:

a former for forming a wet web;

a dewatering section for removing water from the web, comprising:

at least one drying cylinder for drying the web;

a felt forming an endless loop, the felt carrying the web and transferring the web to the drying cylinder in a transfer nip;

a suction device arranged in the loop of the felt and located upstream of the transfer nip, the suction device having a curved suction zone such that the dry solids content of the web is increased by the suction device prior to the web passing through the transfer nip, and the suction device being spaced from the drying cylinder; and a press section for pressing the web against the drying cylinder and transferring the web onto the surface of the drying cylinder, wherein the press section comprises a press element forming the transfer nip with the drying cylinder, wherein the dewatering section is structured and arranged such that from the suction device to the transfer nip, a side of the web facing away from the felt is free from contact with any structural element until said side of the web contacts the drying cylinder in the transfer nip, and wherein the press element comprises a roll selected from the group consisting of a solid press roll, a suction press roll, and a variable crown press roll, said roll being driven.

22. The machine of claim 21, wherein the machine comprises only one press nip.

23. The machine of claim 21, wherein the press element comprises a variable crown press roll operable to control a crown curve of a shell of the press roll independently in at least two zones of the press roll.

24. The machine of claim 23, wherein the variable crown press roll includes a plurality of press members distributed within the shell along a length thereof for exerting radially outward forces on the shell, the press members being arranged in two outer groups and at least one inner group between the two outer groups, each group of press members being controlled independently of the other groups so as to form a plurality of zones of the shell in each of which the crown curve of the shell is independently adjustable, whereby a compression pressure profile imparted to the web in the press nip is controlled by the variable crown press roll.

25. The machine of claim 21, wherein the press felt passes around the suction device with a wrap angle thereabout of at least about 100°.

26. The machine of claim 21, wherein the press felt passes around the suction device with a wrap angle thereabout of at least about 110°.

27. The machine of claim 21, wherein the suction device is operable to increase the dry solids content of the web to at least 15 percent.

28. The machine of claim 21, wherein the suction device is operable to increase the dry solids content of the web to at least 20 percent.

29. The machine of claim 21, wherein the suction device is operable to increase the dry solids content of the web to at least 25 percent.

30. The machine of claim 21, wherein the press element comprises a press roll having a grooved or blind-drilled shell.

31. The machine of claim 21, wherein the suction device comprises a suction roll.

32. The machine of claim 21, wherein the former forms the web on the felt.

33. The machine of claim 21, wherein the former includes an inner web-carrying clothing on which the web is formed, the clothing carrying the web to a transfer point at which the web is transferred from the clothing onto the felt.

34. A machine for manufacturing a web of paper, comprising:

a former for forming a wet web;

a press section for pressing the wet web, the press section comprising a first press element and a second press element and a felt carrying the web through a press nip formed between the press elements, and a suction device arranged in the loop of the felt and located upstream of the press nip, the suction device having a curved suction zone such that the dry solids content of the web is increased by the suction device prior to the web passing through the press nip, and the suction device being spaced from the second press element; and a drying section having at least a first drying cylinder forming the second press element;

wherein the press section and the drying section are combined in one, and the machine has only one press nip, wherein the first press element comprises a roll selected from the group consisting of a solid press roll, a suction press roll, and a variable crown press roll, said roll being driven, and wherein the press section is structured and arranged such that from the suction device to the press nip, a side of the web facing away from the felt is free from contact with any structural element until said side of the web contacts the first drying cylinder in the press nip.

35. The machine of claim 34, wherein the first press element comprises a variable crown press roll operable to control a crown curve of a shell of the press roll independently in at least two zones of the press roll.

36. The machine of claim 35, wherein the variable crown press roll includes a plurality of press members distributed within the shell along a length thereof for exerting radially outward forces on the shell, the press members being arranged in two outer groups and at least one inner group between the two outer groups, each group of press members being controlled independently of the other groups so as to form a plurality of zones of the shell in each of which the crown curve of the shell is independently adjustable, whereby a compression pressure profile imparted to the web in the press nip is controlled by the variable crown press roll.

37. The machine of claim 34, wherein the press felt passes around the suction device with a wrap angle thereabout of at least about 100°.

38. The machine of claim 34, wherein the press felt passes around the suction device with a wrap angle thereabout of at least about 110°.

39. The machine of claim 34, wherein the first press element comprises a press roll having a grooved or blind-drilled shell.

* * * * *

UNITED STATES PATENT AND TRADEMARK OFFICE

CERTIFICATE OF CORRECTION

PATENT NO. : 6,998,022 B2
APPLICATION NO. : 10/299106
DATED : February 14, 2006
INVENTOR(S) : Hultcrantz It is certified that error appears in the above-identified patent and that said Letters Patent is hereby corrected as shown below:

Title page,
Insert the following:
--(30) Foreign Application Priority Data
May 18, 2000 (EP) 00110561.8--.

Signed and Sealed this

Eighth Day of August, 2006

JON W. DUDAS
*Director of the United States Patent and Trademark Office*